US005398374A

United States Patent [19]

Betancourt

[11] Patent Number: 5,398,374

[45] Date of Patent: Mar. 21, 1995

[54] HANDLE ASSEMBLY FOR TRASH BIN

[76] Inventor: Serafin M. Betancourt, 541 Lakeside Cir., Sunrise, Fla. 33326

[21] Appl. No.: 82,490

[22] Filed: Jun. 28, 1993

[51] Int. Cl.[6] ..... E05B 1/00; E05B 7/00

[52] U.S. Cl. ..... 16/110 R

[58] Field of Search ..... 16/110 R, 110 A, 111 R, 16/119, 112, 124, 126; 294/15, 27.1; 220/908, 262, 263, 264, 334

[56] References Cited

U.S. PATENT DOCUMENTS

| | | | |
|---|---|---|---|
| 1,541,066 | 6/1925 | Paalman | 16/110 R |
| 2,498,139 | 2/1950 | Simjian | 16/110 R |
| 3,306,486 | 2/1967 | Martino et al. | 220/334 |
| 3,384,208 | 5/1968 | Renner | 16/110 R |
| 4,363,417 | 12/1982 | Rhoades et al. | 220/908 |
| 4,638,529 | 1/1987 | Katona | 16/111 R |
| 4,722,296 | 2/1988 | Bowskill et al. | 16/111 R |
| 4,862,642 | 9/1989 | Alessi | 16/110 R |
| 4,907,715 | 3/1990 | Bloomer | 220/263 |
| 5,147,056 | 9/1992 | Ma | 220/908 |
| 5,172,823 | 12/1992 | Moetteli | 220/908 |

FOREIGN PATENT DOCUMENTS

| | | | |
|---|---|---|---|
| 96287 | 3/1924 | Austria | 16/110 R |
| 127327 | 8/1928 | Switzerland | 16/110 R |
| 547396 | 8/1942 | United Kingdom | 16/111 |

*Primary Examiner*—P. Austin Bradley
*Assistant Examiner*—Chuck Y. Mah
*Attorney, Agent, or Firm*—Malloy & Malloy

[57] ABSTRACT

A handle assembly designed to be mounted on a pivotally attached closure member of a trash bin wherein the closure member is pivotable into and out of covering relation relative to an access opening through which garbage, debris, etc. is passed into the interior of the trash bin. The handle assembly includes an outwardly and upwardly positioned contact member configured to engage a member of the body of the user wherein the contact member is attached to the closure member by an outwardly and upwardly extending connecting arm. The restructural configuration and disposition of the handle assembly allows the user's hand or other body member to be positioned out of the way of direct contact with any trash, garbage, etc. being passed through the access opening into the interior of the trash bin as well as eliminating the need to touch the exterior surface of the closure member when positioning the closure member into an open position.

6 Claims, 1 Drawing Sheet

HANDLE ASSEMBLY FOR TRASH BIN

BACKGROUND OF THE INVENTION

1. Field of the Invention

This invention relates to a handle assembly mounted on a closure member of a trash bin which facilitates the movement of the closure member into and out of an open position relative to an access opening through which garbage, trash, etc. passes.

2. Description of the Prior Art

The use of trash bins, particularly in fast food restaurants or like establishments, it is common place for the patron, after eating, to remove his own tray with debris, unused food, trash, etc. thereon and empty such debris, etc. into a trash bin. This involves the passage of the contents of the tray through an access opening which is normally covered by a pivotally mounted closure member. To open the closure member, the patron normally places his hand or other body part against the exterior surface of the closure member and pushes it inwardly out of covering relation to the access opening. The debris on the tray is then passed through the access opening. This procedure frequently results in trash, debris, etc. coming in direct contact with the user's hand. Alternatively, the hand of the user engages a significantly large exterior surface of the closure member which has been touched repeatedly by many patrons.

In order to avoid such relatively unsanitary conditions, there is an obvious need in this area for some type of handle assembly which allows the positioning of the patron hand, when opening the closure member to be clearly free of any contact with debris and also preferably out of direct contact with the exterior surface of the closure member itself.

Attempts in the prior art are evidenced by structures disclosed in the following U.S. patents to overcome problems of this type.

The patent to Moetteli, U.S. Pat. No. 5,172,823, discloses a combination dust pan and trap door receptacle closure having a handle and hinge means to allow the pivotal mounting of the receptacles such that removal of the closure from the receptacle is not necessary to deposit refuse in the receptacle such that the hands need not come into direct contact with the soil closure Surface in order to access the inside of the receptacle. This device, however, is clearly intended to be removable from its covering position relative to the access opening and the handle of the dust pan disclosure is positioned so that the natural inclination of one is to still touch the exterior surface of the dust pan thereby providing the same sanitary problems as exists with other current constructions.

The patent to Lombardi, et al., U.S. Pat. No. 4,893,719, discloses a trash container having an upper closure member with somewhat of a pivotal connection disposal into and out of covering relation to an access opening which leads to the interior container. No handle or other outwardly and upwardly extending members provided.

The patent to Lai, U.S. Pat. No. 5,090,309, discloses a waste container including a hollow body having an open top end a cover detachably provided on the open top end as well as the press member movably mounted on the cover to manipulate and/or remove the press member and otherwise manipulate such member relative to the interior of the trash bin or container.

The patent to Ma, U.S. Pat. No. 5,147,056, discloses a trash bin type of apparatus having a closure member which is selectively positionable between an open and closed position relative to an access opening by means of a remotely disposed structure which is intended to be operated by the foot of a spaced location from the closure member or access opening thereby eliminating the possibility of debris coming into contact with the user.

While the structures disclosed in the above-noted patents are attempting to cover similar relatively nonsanitary conditions, such structures do not fully accomplish their intended function in that such structures may be overly complicated or alternately still permit a tendency of the exterior surface of a closure member to be contacted by the hand of the user and thereby come into contact with any refuse or the like.

SUMMARY OF THE INVENTION

The present invention is directed to a handle assembly of the type which is intended to be attached to the exterior surface of a pivotally mounted closure member. The closure member is part of a trash bin and is pivotally mounted to pivot along a substantially .horizontal access of rotation, into and out of covering relation to an access opening. The access opening is provided to allow refuse to pass therethrough, such as when a patron empties his own tray or like facility in a fast food restaurant or like establishment.

The handle assembly includes a contact member or actual handle element which preferably has an elongated configuration and a shape and otherwise dimensioned to allow gripping or more specifically contact with the handle or other body member of the patron. The contact member, by virtue of a connecting means in the form of at least one or preferably a plurality of connecting arms extends outwardly and upwardly well above the closure member. The degree of outward and upward extension of the contact member relative to the exterior surface of the closure member allows a somewhat downward and inward force to be exerted on the contact member. This in turn causes the closure member to pass into the interior of the trash bin leaving the access opening clear to permit refuse to pass therethrough. However, the disposition of the contact member of the subject handle assembly is such as to allow positioning of the hand of the patron clearly out of the path assumed by the refuse as it passes through the access opening into the interior of the trash bin.

An important feature of the present feature is the dimension, configuration and disposition of the contact member such that adequate exterior surface is provided to allow a firm contact with the patron's hand, or other body member of the patron, so as to exert the aforementioned downward and somewhat pushing force thereon. Also, the outer and upward disposition of the contact member completely clear of the closure member and/or the exterior surface thereof ensures that the hand of the patron will not come into direct contact with any garbage, left over food, refuse, etc. left on the tray, which passes through the access opening into the interior of the trash bin.

Sanitary conditions are thereby greatly improved since the hand of the patron no longer has to come in contact with the refuse on the tray and also does not have to come into contact with the exterior surface of the closure member to open such closure member.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
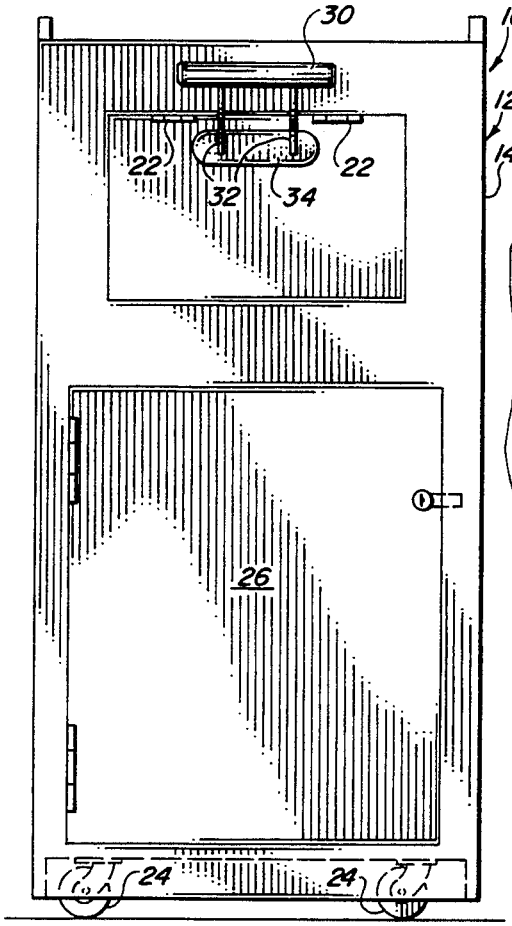
FIG. 1 is a front view of the subject handle assembly mounted on a closure member of a trash bin.

As shown in the accompanying figures, the present invention relates to a handle assembly generally indicated as 10 being attached to and in certain embodiments used in combination with a trash bin generally indicated as 12. The trash bin includes a housing or the like 14 having a hollow interior in which trash, refuse, etc. is to be placed or positioned for collection by any type of container or the like. Such trash or refuse is passed through an access opening 16 of sufficient size and dimension to allow passage of such refuse therethrough. A closure member 18 is hingedly or pivotally attached about one peripheral edge as at 20 such that the closure member 18 pivots about a substantially horizontally oriented access of rotation. Hinge members as at 22 may be used to accomplish such pivotal attachment. Other features of the trash bin 20 which are not necessarily an important part of the present invention include an alternate mounting of the bin on wheels, coasters, or the like as at 24 and the provision of a door member 26 to provide clear access to the interior of the bin 14 for purposes of removing or supplying a container therein for the retention of the refuse emptied through the access opening 16.

Figure 2:
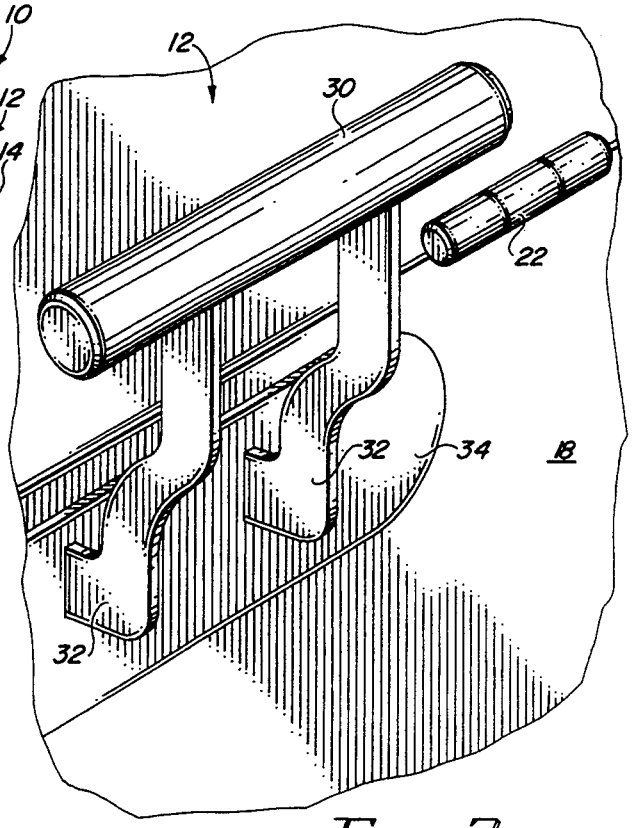
FIG. 2 is a perspective view and partial cutaway showing details and disposition of the subject handle assembly when the closure member is in a closed position relative to an access opening.
Figure 3:
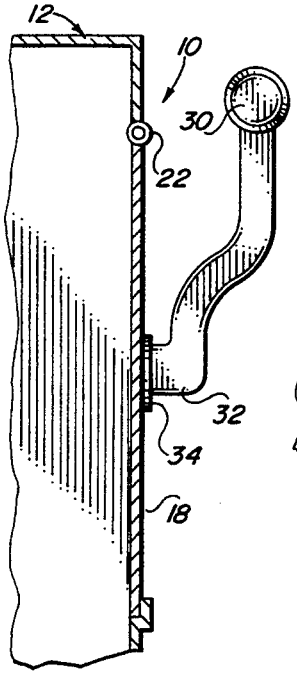
FIG. 3 is a side view and partial cutaway of the subject handle assembly when the closure member is in a closed position relative to an access opening of a trash bin.

With reference to FIGS. 1-3, the handle assembly includes a contact member 30 preferably having an elongated configuration and being mounted in a horizontal orientation. The contact member 30 is overall dimensioned and configured to allow either gripping or type of contact by the hand or other body part of a patron as shown in FIG. 3. As will be explained in greater detail hereinafter, the hand of the patron is intended to exert a somewhat downward and inward pushing force on the contact member which serves to pivot the closure member 18 out of its closed position relative to the access opening 16 and further position the patron's hand out of any path of travel of the refuse, trash, etc. which passes through the access opening into the interior of the trash bin 12.

The proper positioning of the contact member 30 is therefore well above and outwardly from the closure member 18 and more specifically the exterior surface thereof. This is accomplished through the provision of connecting means in the form of at least one but preferably a plurality of connecting arms 32 disposed in spaced apart relation to one another. The connecting arms 32 have an outermost end secured to or integrally formed on the contact member 30. An innermost end of each of the connecting arms 32 is attached to a mounting means generally indicated as 34. This mounting means may be in the form of a plate which may be connected to the closure member 18 or the exterior surface thereof by any type of conventional connector such as screws, bolts, etc. Alternately, the connecting means may be in the form of the innermost ends of the connecting arms 32 being integrally formed on the closure member 18 or being themselves attached thereto by the aforementioned type of connecting members (not shown for purposes of clarity).

The connecting arm or arms 32 also have an elongated configuration and are a sufficient dimension and overall configuration to extend not only outwardly from the exterior surface of the closure member 18 but upwardly therefrom. In a preferred embodiment, preferably shown in FIGS. 1, 2, and 3, the contact member, by virtue of the dimension, configuration, and disposition of the connecting arms 32 is disposed well above the closure member 16 and also well above the pivotally attached peripheral edge 20.

Figure 4:
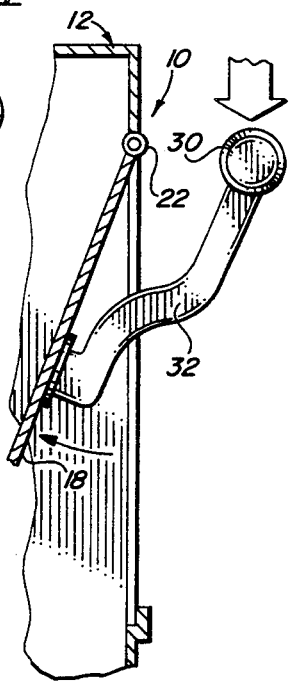
FIG. 4 is a side view of the handle assembly and partial cutaway showing a force being exerted on the handle assembly in the direction of the arrow moving the closure member into an open position relative to the access opening.
Figure 5:
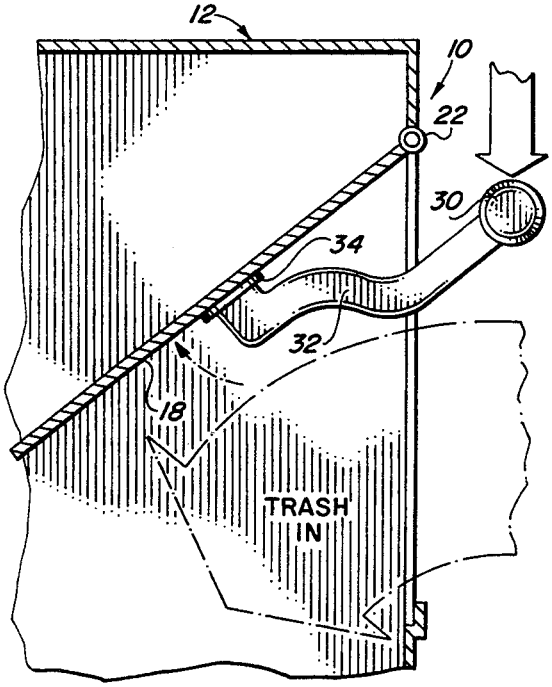
FIG. 5 is a side view of the handle assembly and partial cutaway showing a force being exerted on the handle assembly in the direction of the arrow whereby the closure member is disposed in the open position relative to the access opening.

As shown in FIG. 3 through 5, the patron's hand, when exerting a downwardly and inwardly pushing force thereon as indicated by the directional arrow associated with FIG. 3 through 5, is disposed clearly out of the path of contact of any refuse as it passes through the access opening into the interior of the trash bin 12.

Now that the invention has been described,

What is claimed is:

1. A handle assembly used in combination with a trash bin which includes a closure member pivotally mounted about a horizontally oriented edge to cover an access opening of such trash bin and movable relative to said access opening between an normally closed position and an open position, said assembly comprising:

a) a contact member structured for receiving a force thereupon, b) mounting means structured and disposed for fixed attachment to the closure member, c) connecting means structured and disposed for interconnecting said mounting means and said contact member, d) said connecting means including at least one connecting arm having a lower section, an upper section, and an intermediate section interconnecting said lower and upper sections, e) said lower section being fixedly secured to said mounting means, said lower section extending outwardly from said mounting means in substantially perpendicular relation thereto, said upper section being fixedly secured to said contact member in supporting relation thereto, said upper section extending generally downwardly from said contact member, f) said intermediate section having a top zone and a bottom zone, said bottom zone extending generally upwardly from said lower section, said bottom zone being disposed substantially parallel to said upper section in spaced relation thereto, said top zone extending between said bottom zone and said upper section, g) said at least one connecting arm being structured and dimensioned to dispose said contact member above at least a majority of the closure member and outwardly therefrom, h) said contact member being disposed to pivot the closure member into the open position upon a force being exerted upon said contact member.

2. An assembly as recited in claim 1 wherein said contact member comprises an elongated configuration connected to said at least one arm in substantially transverse relation thereto, said contact member being disposed in a substantially horizontal orientation.

3. An assembly as recited in claim 2 wherein said connecting means comprises a plurality of connecting arms each having a lower section, an upper section, and an intermediate section interconnecting said lower and upper sections, said lower section being fixedly secured to said mounting means, said lower section extending outwardly from said mounting means in substantially perpendicular relation thereto, said upper section being fixedly secured to said contact member in supporting relation thereto, said upper section extending generally downwardly from said contact member, said intermediate section having a top zone and a bottom zone, said bottom zone extending generally upwardly from said lower section, said bottom zone being disposed substantially parallel to said upper section in spaced relation thereto, said top zone extending between said bottom zone and said upper section.

4. An assembly as recited in claim 3 wherein said plurality of connecting arms are disposed in spaced, substantially parallel relation to one another.

5. An assembly as recited in claim 4 wherein said contact member is connected to said plurality of arms in substantially transverse relation thereto, said contact member being disposed in a substantially horizontal orientation.

6. An assembly as recited in claim 5 wherein said contact member comprises an elongated configuration terminating in oppositely disposed longitudinal ends, said contact member being connected to said plurality of connecting arms on a location on said contact member between said opposite ends.

* * * * *